United States Patent [19]

Gladish

[11] Patent Number: 4,985,950

[45] Date of Patent: Jan. 22, 1991

[54] DETACHABLE HANGING HEADREST/PILLOW

[76] Inventor: William C. Gladish, 3506 Latana Way, Beale AFB, Calif. 95903

[21] Appl. No.: 511,331

[22] Filed: Apr. 19, 1990

[51] Int. Cl.[5] ..... A47C 20/00

[52] U.S. Cl. ..... 5/437; 5/434; 297/395

[58] Field of Search ..... 5/434, 436, 437, 440, 5/441; 297/395, 397

[56] References Cited

U.S. PATENT DOCUMENTS

| | | | |
|---|---|---|---|
| 1,559,119 | 10/1925 | Miller | 5/411 |
| 1,644,402 | 10/1927 | Rosswinkle | 297/397 |
| 2,167,178 | 7/1939 | Kohlstadt . | |
| 2,260,437 | 10/1941 | Chambers | 5/436 |
| 3,003,815 | 10/1961 | Zinn | 5/434 X |
| 3,220,770 | 11/1964 | Schaeffer . | |
| 3,608,964 | 9/1971 | Earl | 297/397 |
| 4,731,891 | 3/1988 | Scheurer | 5/434 |

FOREIGN PATENT DOCUMENTS

| | | | |
|---|---|---|---|
| 2452899 | 5/1976 | Fed. Rep. of Germany | 5/434 |
| 539056 | 3/1922 | France | 297/397 |
| 91685 | 6/1968 | France | 297/395 |
| 2194883 | 3/1988 | United Kingdom | 5/441 |

*Primary Examiner*—Michael F. Trettel
*Attorney, Agent, or Firm*—James M. Ritchey

[57] ABSTRACT

An invention having an attachment strip assembly (20) which can be connected to a headrest/pillow assembly (42) in a 360 degree circle and allows headrest/pillow assembly (42) to hang in place. Depending on the embodiment, the invention may contain any number of attachment strip assemblies (20) and surface attachment devices to provide adequate support and operational flexibility. Attachment strip assembly (20) can be easily removed from headrest/pillow assembly (42) allowing headrest/pillow assembly (42) to be used as a standard headrest/pillow.

10 Claims, 15 Drawing Sheets

DETACHABLE HANGING HEADREST/PILLOW

BACKGROUND—FIELD OF INVENTION

This invention relates to headrests/pillows, specifically to headrests/pillows which can hang in place and also function as a nonhanging headrest/pillow.

BACKGROUND—DESCRIPTION OF PRIOR ART

Heretofore, inventors have created several types of headrests/pillows to hang in place.

U.S. Pat. No. 4,731,891 to Scheurer, Mar. 22, 1988 discloses a headrest/pillow which can hang in place but would be difficult to use as a nonhanging headrest/pillow because the suction cups are not detachable. It also requires thick cushioning because the suction cups are attached on the back of the headrest/pillow. It requires the surface, for the suction cup, to be located directly behind the pillow, allowing little location flexibility for attachment to a surface. The suction cup cannot be interchanged with other surface attachment devices by the user. This allows no surface attachment flexibility.

U.S. Pat. No. 3,220,770 to N. Schaeffer, Nov. 30, 1965 discloses a headrest/pillow that will hang in place but by only one means, between the top edge of an automobile window and the automobile frame when the window is closed, allowing almost no flexibility for hanging. This hanging method interferes with the complete closure of the window causing extra road noise. It could also damage the rubber seal around the window. The tab hanging out the window is unsightly and would cause additional noise blowing in the wind. The nondetachable tab portion would interfere with the user as a nonhanging headrest/pillow.

U.S. Pat. No. 2,167,178 to M. M. Kohlstadt in July 25, 1939 discloses a headrest/pillow with suction cups attached to tabs on the side of the headrest/pillow. This is a complicated and expensive design. The suction cups do not appear to be detachable once installed, if they are it would be very difficult and time consuming to remove and attach all of them. The stiff tabs on the sides of the headrest/pillow would make it very awkward, uncomfortable, and impractical as a nonhanging headrest/pillow. This headrest/pillow is also restricted to suction cup surfaces allowing no surface flexibility.

OBJECTS AND ADVANTAGES

Accordingly, several objects and advantages of my invention are:

(a) to provide a headrest/pillow which will hang in place and also function as a convenient and comfortable nonhanging headrest/pillow.

(b) to provide a headrest/pillow that allows extreme location and surface flexibility when attaching the headrest/pillow.

(c) to provide a headrest/pillow requiring less cushioning material and providing more convenience by not positioning the surface attachment device on the backside of the headrest/pillow.

(d) to provide a hanging headrest/pillow which allows expression and display of a person's sentiments, advertising, art work, slogans, etc.

(e) to provide a headrest/pillow which would not interfere with the closure of windows, cause possible damage to window seals, or increase road noise.

(f) to provide a headrest/pillow which is easily repaired. The headrest/pillow can be easilY broken down into two, three, four or five parts, depending on the embodiment. This allows inexpensive repair and easy storage.

Further objects and advantages of my invention will become apparent from a consideration of the drawings and ensuing description of it.

DRAWING FIGURES

REFERENCE NUMERALS IN DRAWINGS

"VELCRO®" is a trademark of VELCRO USA INC., Manchester, N.H.

| | | | |
|---|---|---|---|
| 20 | attachment strip assembly | 22 | suction cup |
| 24 | attachment strip | 24a | small attachment strip |
| 26 | hole | 28 | suction cup attachment head |
| 30 | clamp | 32 | magnet |
| 34 | peanut attachment device | 36 | protective covering |
| 38 | "VELCRO" fastener | 38a | loop/soft section of "VELCRO" |
| 38b | hook/hard section of VELCRO | 40 | cushioning material |
| 42 | headrest/pillow assembly | 44 | slit |
| 46 | car window | 48 | edge or tab |
| 50 | bed frame | 52 | metal bed frame |

DESCRIPTION—FIGS. 1 TO 7

Figure 1:
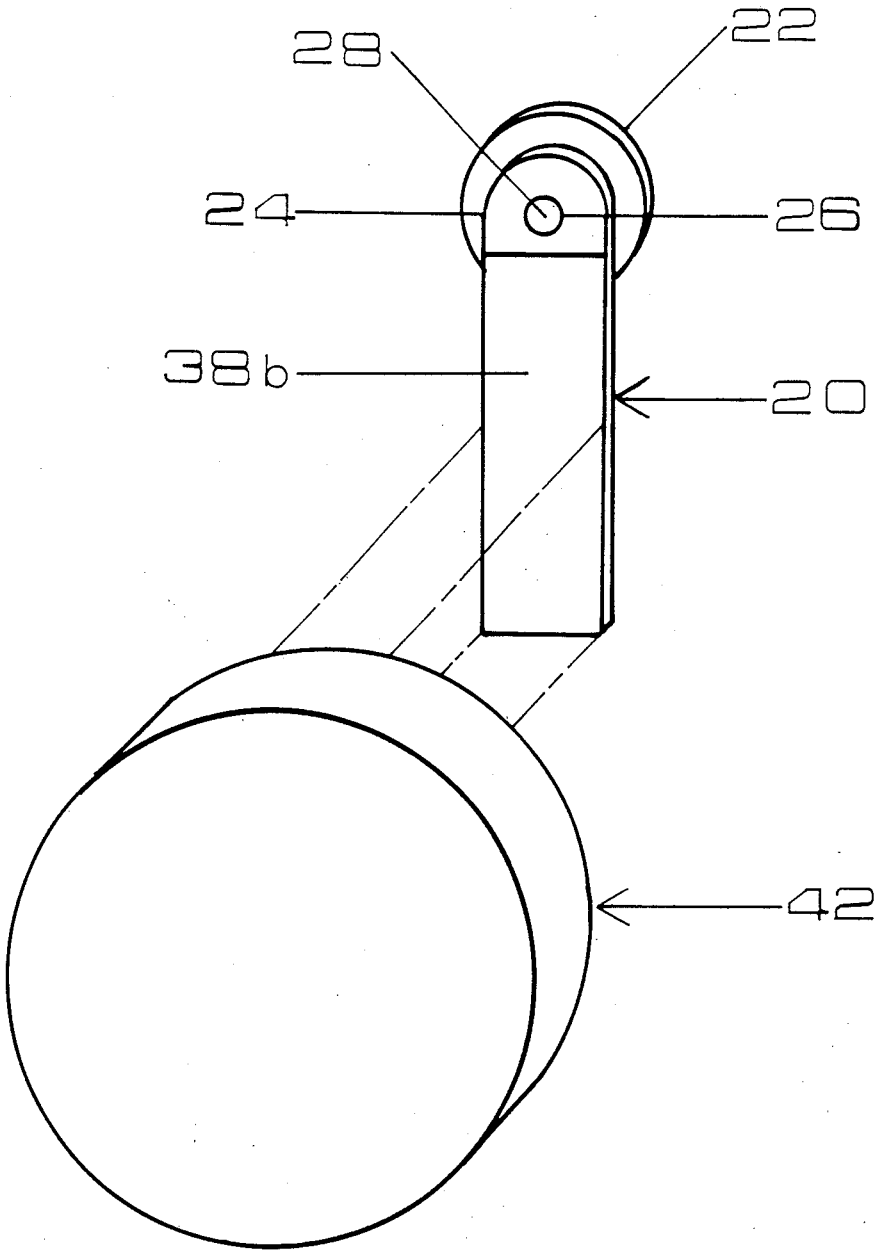
FIG. 1 is a perspective view of my invention.
Figure 2:
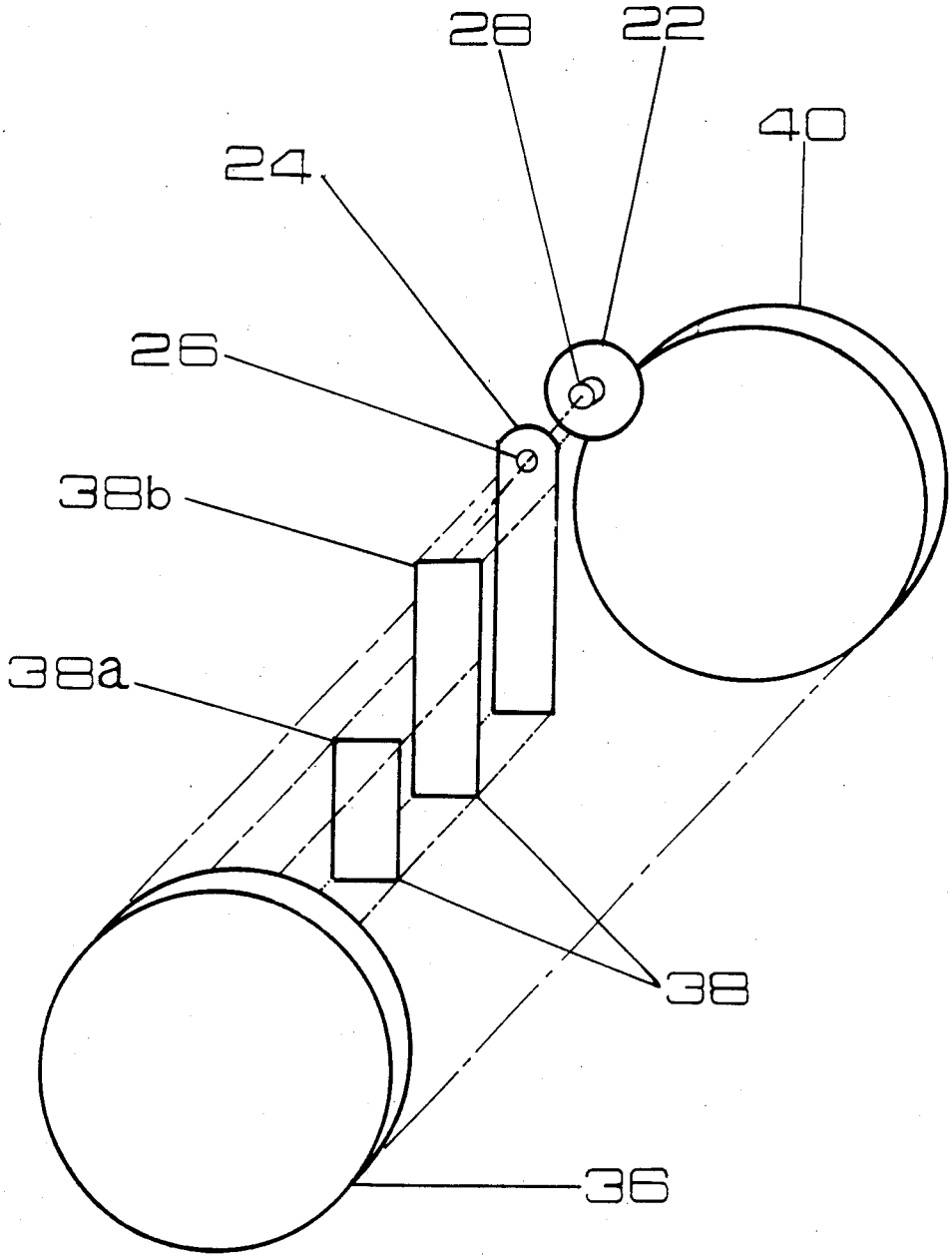
FIG. 2 is an exploded view of my invention.

A typical embodiment of the headrest/pillow of the present invention is illustrated in FIG. 1 and FIG. 2.

Figure 3:
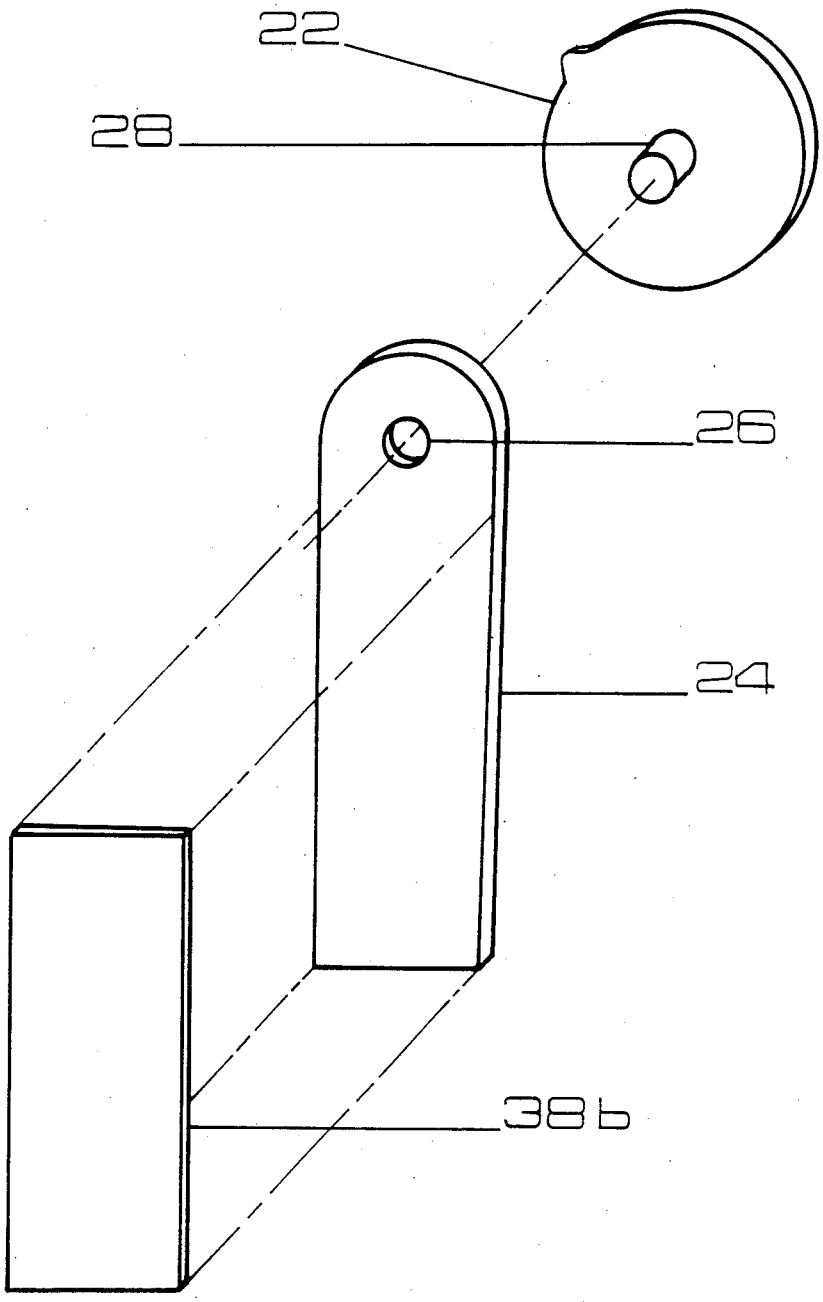
FIG. 3 is an exploded view of a suction cup attachment strip assembly.

In a typical embodiment an attachment strip assembly 20 as shown in FIG. 3 consists of three parts, a suction cup 22, an attachment strip 24, and a hook/hard section of "VELCRO®" 38*b*, "VELCRO®" is a trademark of VELCRO USA INC. of Manchester, N.H.

In a typical embodiment suction cup 22 is attached to attachment strip 24 by inserting it into a hole 26 slightly smaller than a suction cup attachment head 28. Suction cup 22 is available from many manufacturing companies, Adams Manufacturing Company of Portersville, Pa. is one example.

Figure 4:
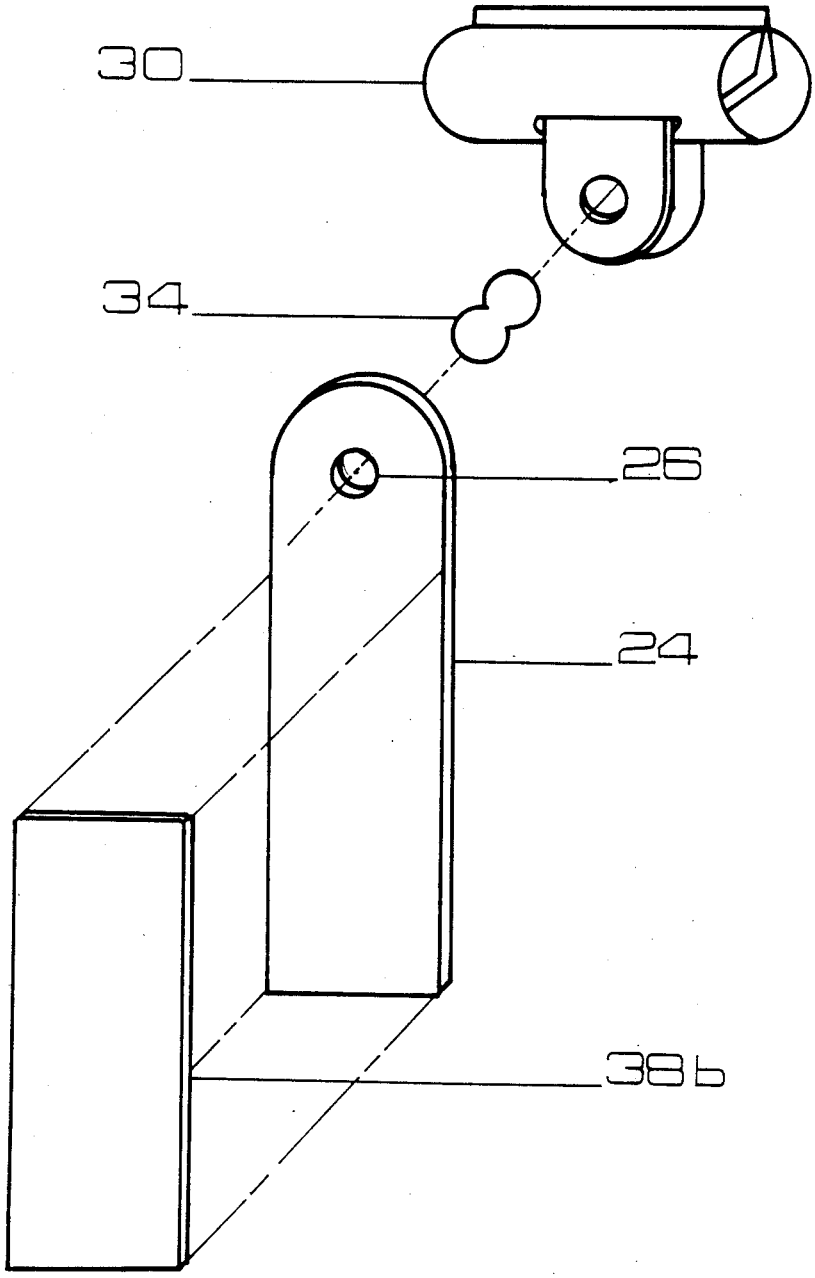
FIG. 4 is an exploded view of a clamp attachment strip assembly.
Figure 5:
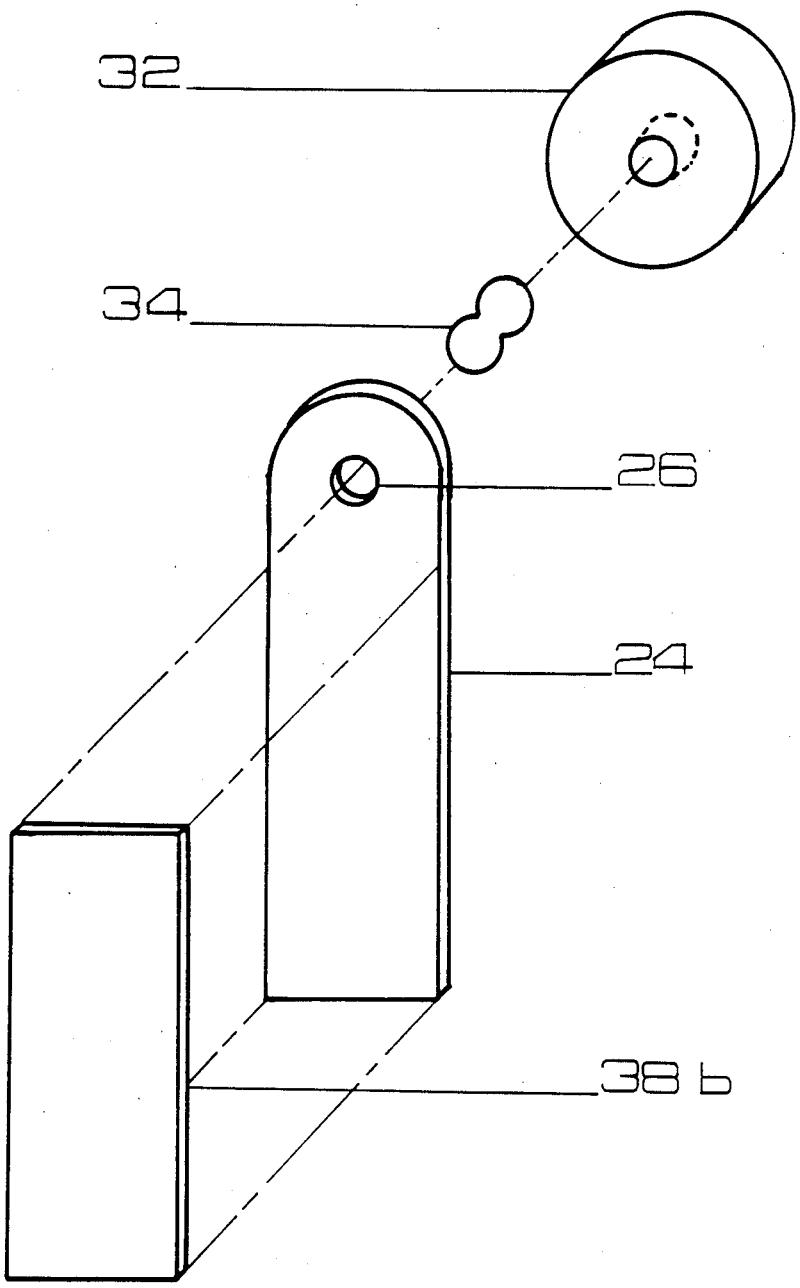
FIG. 5 is an exploded view of a magnet attachment strip assembly.
Figure 6:
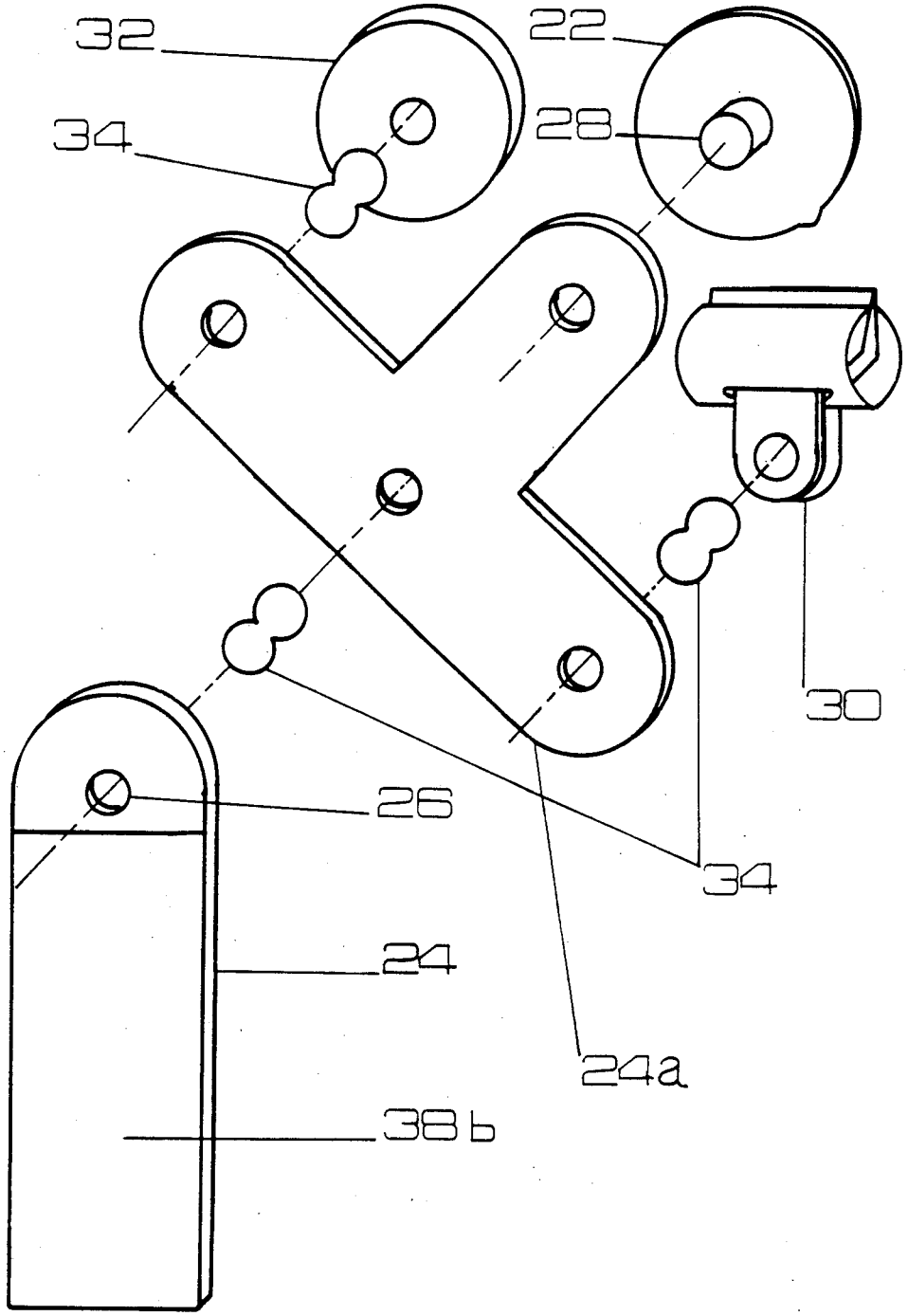
FIG. 6 is an exploded view of suction, clamp, and magnet combination attachment strip assembly.

In the preferred embodiment suction cup 22 is interchangeable with a clamp 30, and a magnet 32 as shown in FIGS. 4 and 5, secured to attachment strip 24 with a peanut attaching device 34. As shown in FIG. 6 suction cup 22, clamp 30, and magnet 32 can be combined by securing them to a small attachment strip 24*a*, using peanut attachment devices 34. Small attachment strip 24*a* is then attached to attachment strip peanut attachment device 34. Suction cup 22, clamp 30, and magnet 32 could also be interchanged with other surface attachment devices, for example keeper, pin, etc.

The top and bottom of peanut attachment device 34 are slightly larger than the holes they fit into but will collapse when forced, once though or in they will expand and secure themselves and are easily removed in the same manner. In the preferred embodiment peanut attachment device 34 is made from silicone, but could be made from other similar compounds. Peanut attachment device 34 could be substituted using other fasteners, for example "VELCRO®", screw, etc. Surface attachment devices could be permanently secured by glue, sewing, etc.

Attachment strip 24 and small attachment strip 24*a* can be made of flexible or rigid material. In the preferred embodiment attachment strip 24 and small attachment strip 24*a* is clear vinyl, available from many manufacturing companies. Precision Plastics of Fresno, Calif. is one example. Other possible material could be rigid or flexible plastic, leather, rubber, nylon, etc. Attachment strip 24 and small attachment strip 24*a* could be the same material or different.

In the preferred embodiment attachment strip 24 as shown in FIG. 2, is attached to the back of a protective covering 36 by a strip of "VELCRO®" fastener 38. A loop/soft section of "VELCRO®" 38*a* would be sewn on the back of protective covering 36. Hook/hard section of "VELCRO®" 38*b* would be glued to attachment strip 24 using cyanoacrylate glue. However "VELCRO®" fastener 38 could be attached in various combinations of sewing and/or various glues. "VELCRO®" fastener 38 could be substituted for various other quick fasteners like snaps, buttons, etc.

Figure 7:
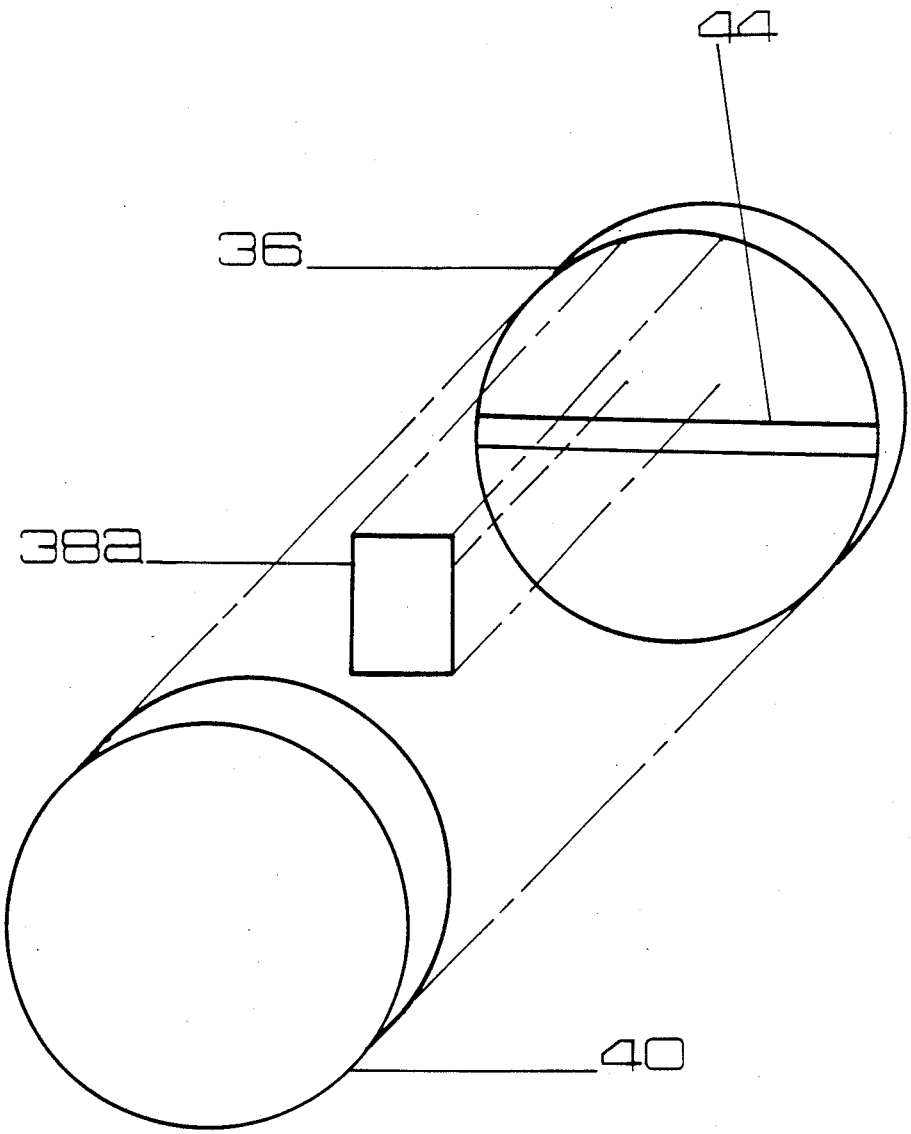
FIG. 7 is an exploded view of a headrest/pillow assembly.

In the preferred embodiment a headrest/pillow assembly 42 as shown in FIG. 7, consist of three parts, protective covering 36, loop/soft section of "VELCRO®" 38*a*, a cushioning material 40. Protective covering 36 has a front and back with a surrounding perimeter edge and is shaped and sewn from soft, durable cloth, however it can be made from vinyl, leather, etc. Cushioning material 40 is cut from urethane foam to fit snugly into protective covering 36. Urethane foam is manufactured by many companies. American Excelsior Company of Arlington Tex. is one example. However the cushioning material could also consist of a sack of down, feathers, polyester fiber, etc.

In the preferred embodiment protective covering 36 has a slit 44 in the back to allow cushioning material 40 to be inserted or removed easily. However protective covering 36 could be a sack made from the same material mentioned above and filled with the same cushioning material mentioned above, then sealed shut by sewing, gluing, etc.

From the description above, a number of advantages of my headrest/pillow becomes evident:

(a) the headrest/pillow will hang in place and also function as a convenient and comfortable nonhanging headrest/pillow.

(b) the headrest/pillow allows extreme location and surface flexibility.

(c) the headrest/pillow requires less cushioning material by not positioning the surface attachment device on the backside of the headrest/pillow.

(d) the hanging headrest/pillow will allow people to express and display their sentiments, advertising, art work, slogans, etc.

(e) the headrest/pillow will not interfere with the closure of windows, cause possible damage to window seals, or increase road noise.

(f) the headrest/pillow can be easily broken down into several parts for easy storage and expensive repair.

OPERATION AS SHOWN IN—FIGS. 2, 3, 7 TO 15

Figure 8:
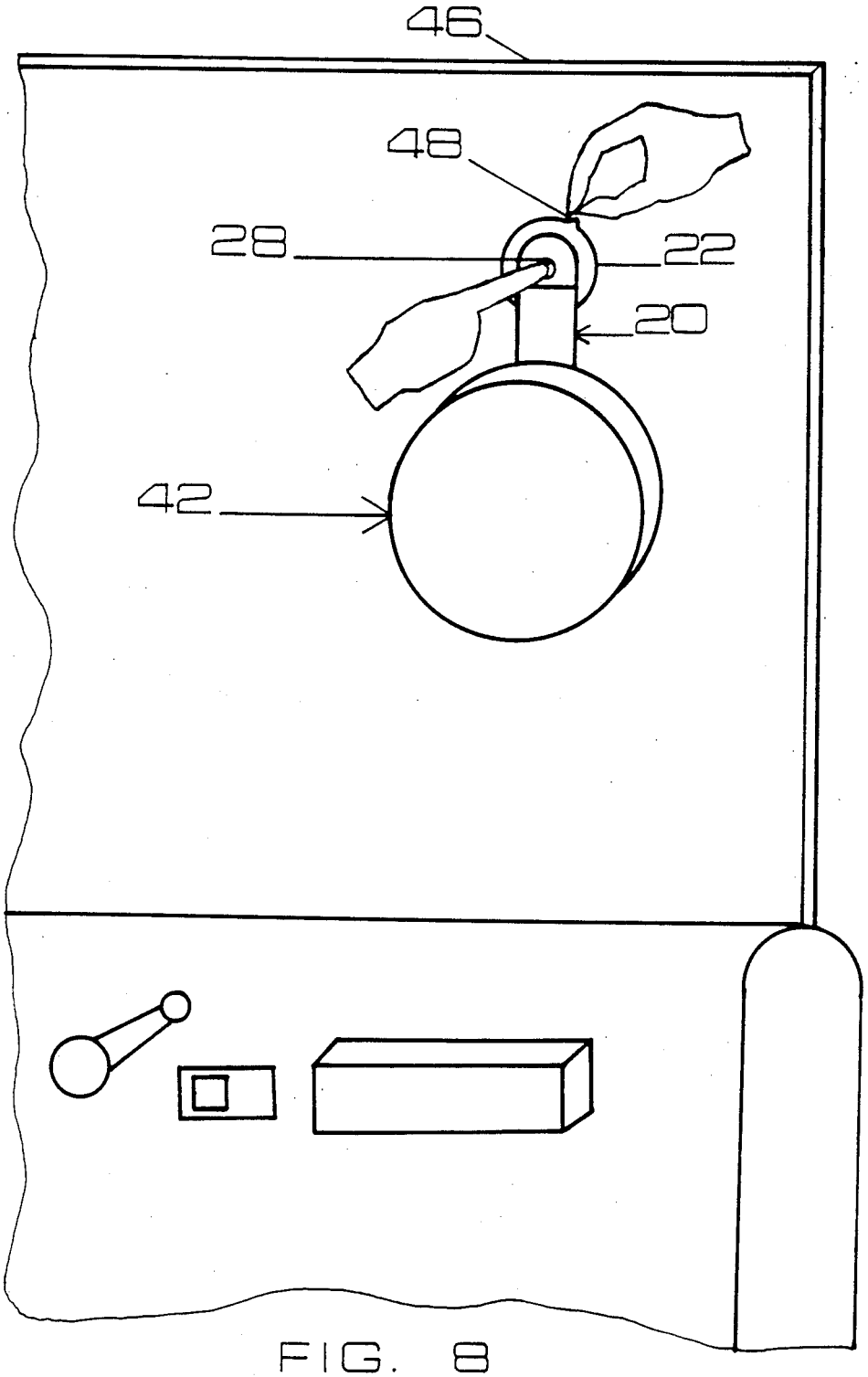
FIG. 8 is a perspective view of my invention attached to a car window and showing how to attach and remove it properly.
Figure 9:
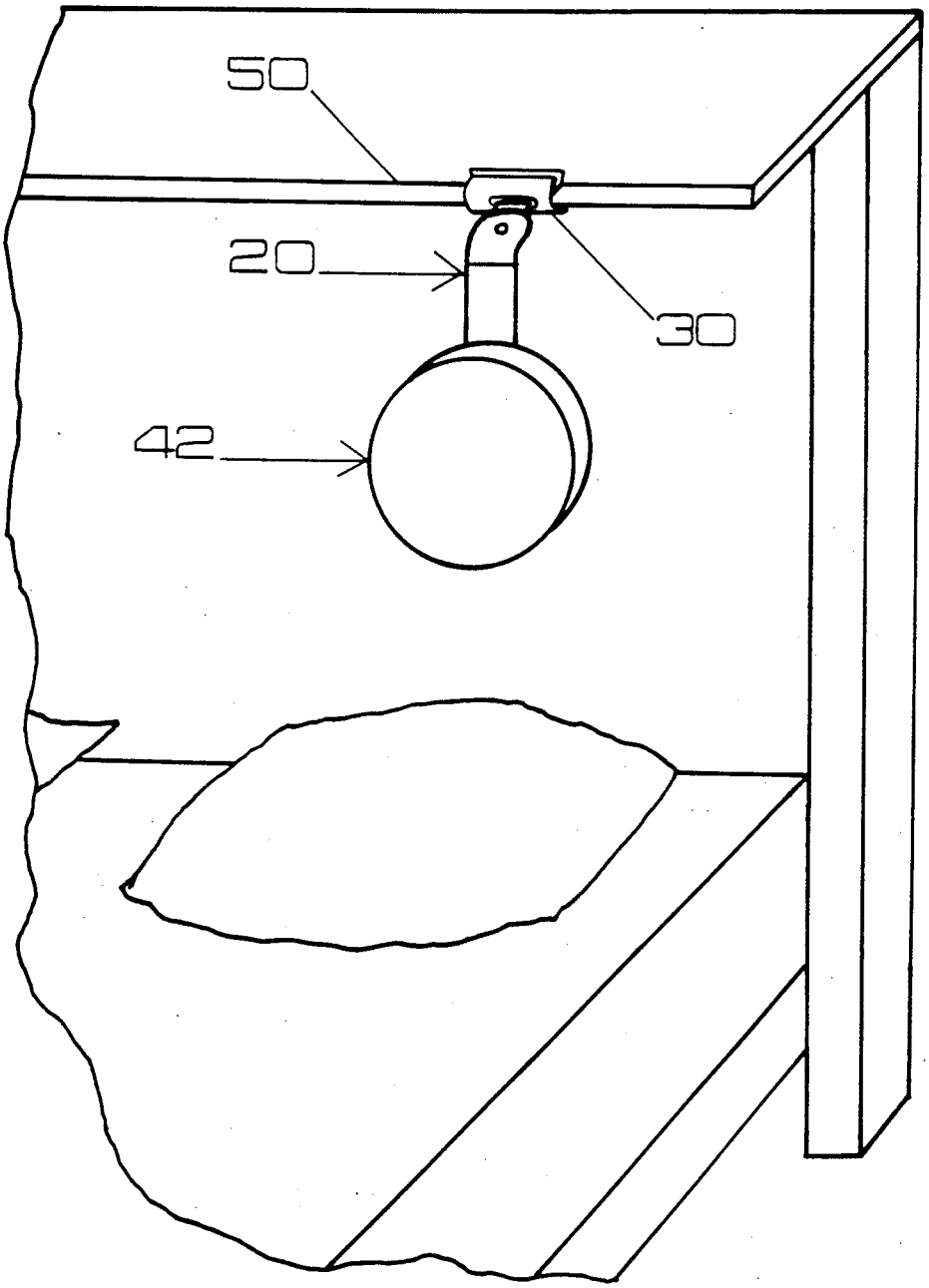
FIG. 9 is a perspective view of my invention with a clamp attached the frame of a bed.
Figure 10:
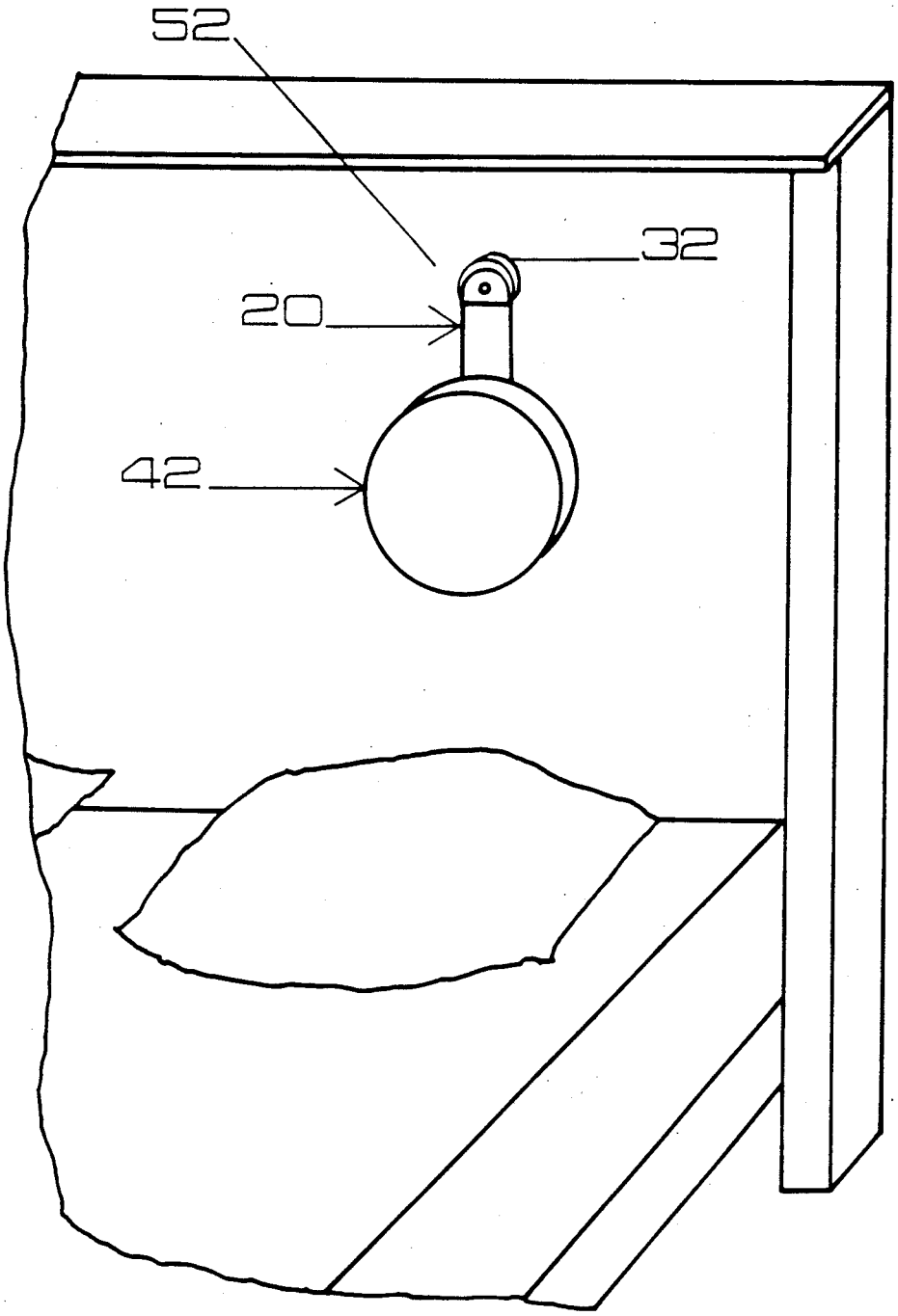
FIG. 10 is a perspective view of my invention with a magnet attached to the metal frame of a bed.

In a typical embodiment suction cup 22, as shown in FIG. 8, functions to secure the headrest/pillow to any smooth surface, this allows one to move their body without their headrest/pillow falling. It will not interfere with the closure of a window or cause damage to the rubber seal around the window frame. To operate, one merely pushes suction cup attachment head 28 until the suction cup collapses onto the surface, like a car window 46 for example. To remove suction cup 22 from a surface, pull at an edge or tab 48 of suction cup 22 in contact with the surface. Operation of clamp 30 and example of use on a bed frame 50 is depicted in FIG. 9. Operation of magnet 32 and example of use on a metal bed frame 52 is depicted in FIG. 10.

Figure 11:
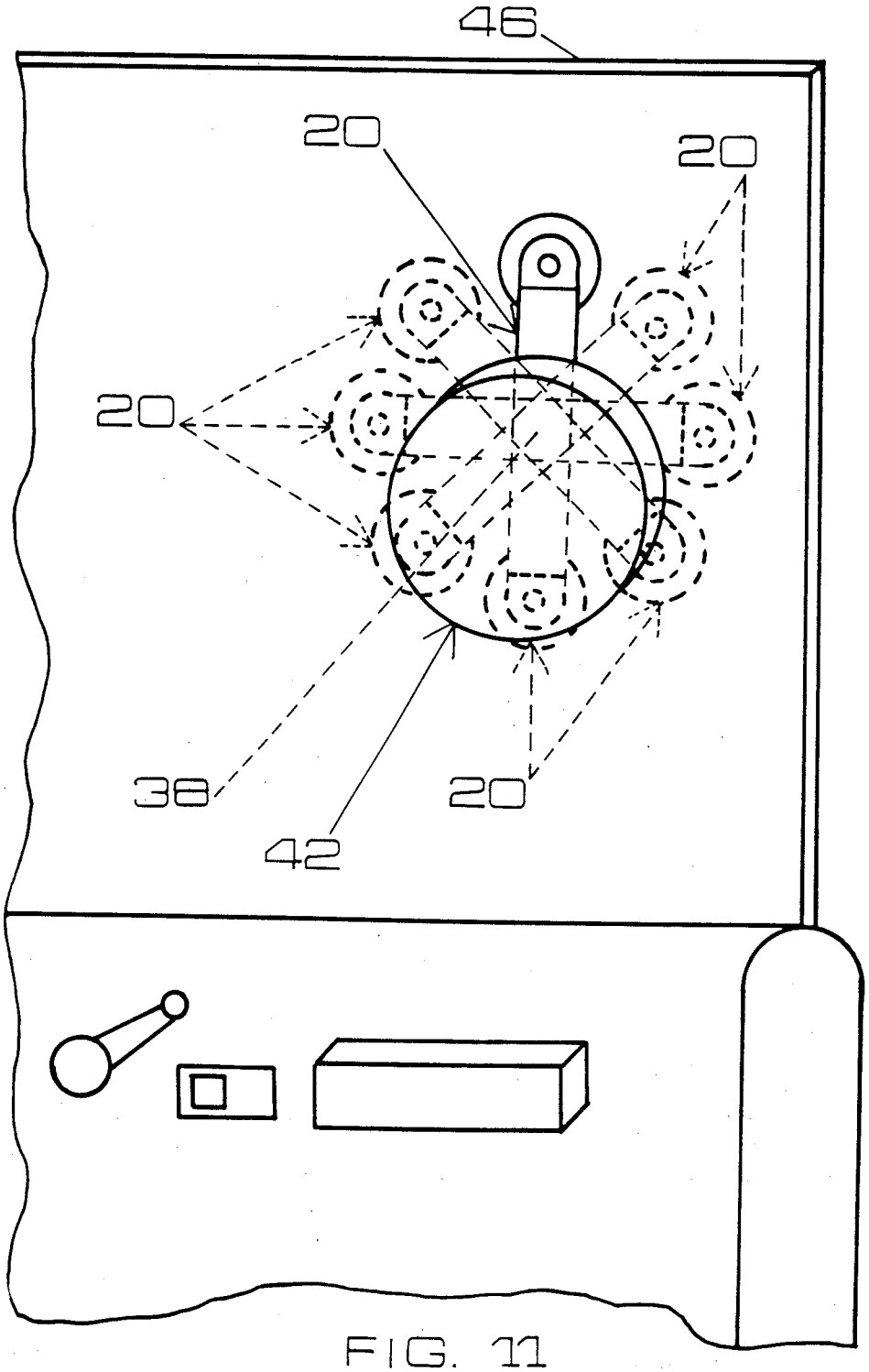
FIG. 11 is a perspective view of my invention attached to a car window and showing the various positions the attachment strip assembly could have.

In a typical embodiment attachment strip 24, as shown in FIG. 3, functions to connect suction cup 22 with hook/hard section of "VELCRO®" 38*b*, which in turn makes up attachment strip assembly 20. Attachment strip assembly 20 has several functions. FIG. 8 shows how it attaches to headrest/pillow assembly 42 so both will hang in place. Since a suction cup 22 (or other surface attachment device) is secured to one end of an attachment strip 24 and a quick fastener ("VELCRO®" and the like) is secured to the other end of the attachment strip 24, the attachment strip 24 functions to keep suction cup 22 from being positioned behind headrest/pillow assembly 42 unless desired. This requires less cushioning material than if the suction cup was attached in the back, thereby reducing bulkiness and cost. FIG. 11 shows how it allows the point where the suction cup is attached to the smooth surface to change while not changing the position of headrest/pillow assembly 42.

Figure 12:
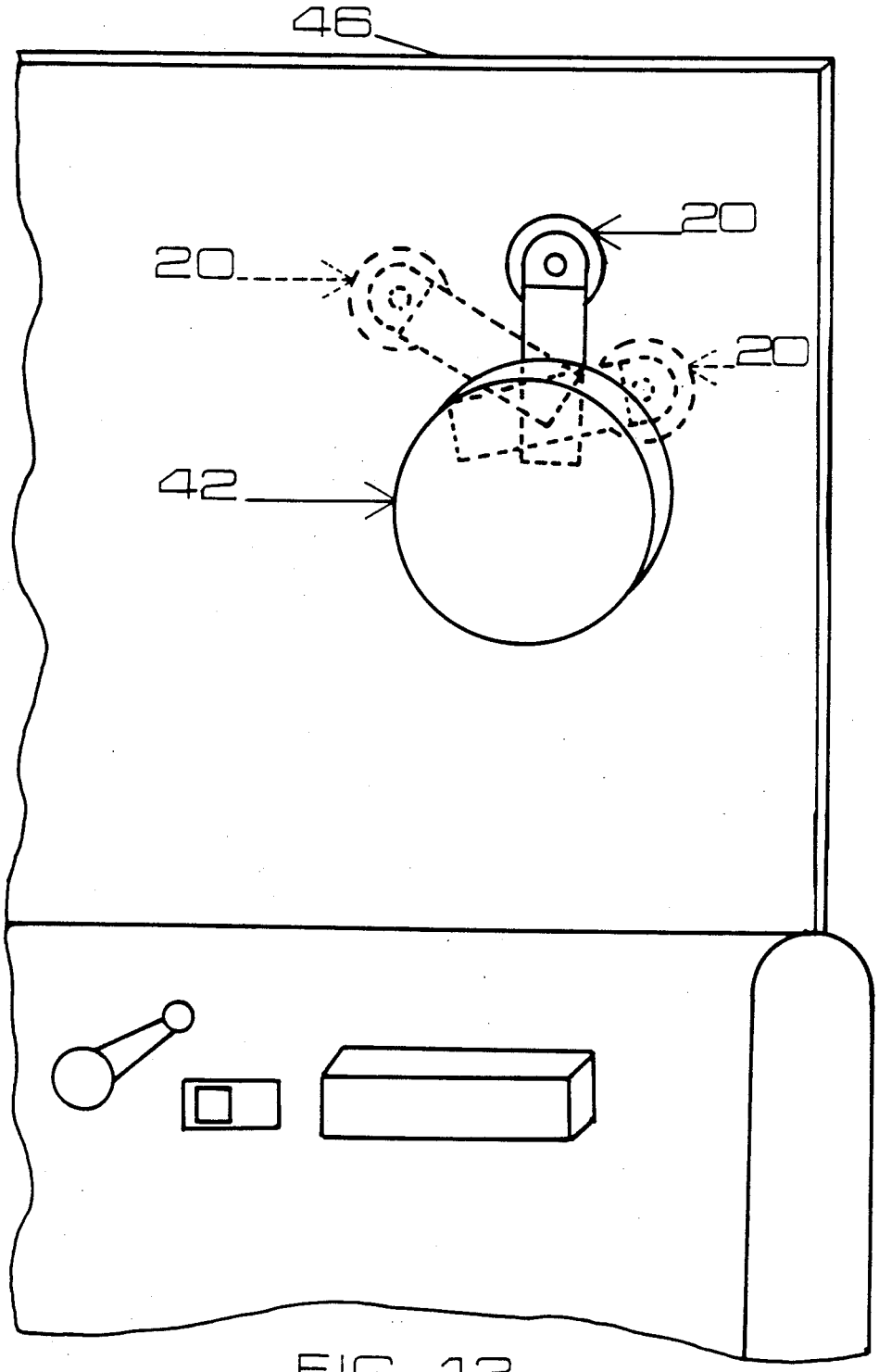
FIG. 12 is a perspective view of my invention showing the various attachment points along the attachment strip assembly with the headrest/pillow assembly.

"VELCRO®" fastener 38 functions to allow quick and easy removal and connection of attachment strip assembly 20 and headrest/pillow assembly 42. It also functions so that attachment strip assembly 20 can be attached in a 360 degree circle. FIG. 12 shows how it allows the attachment point between attachment strip assemblY 20 and headrest/pillow assembly 42 to change along attachment strip assembly 20. Combining these two features gives the user extreme flexibility in attaching the headrest/pillow to the desired location on a surface.

Figure 13:
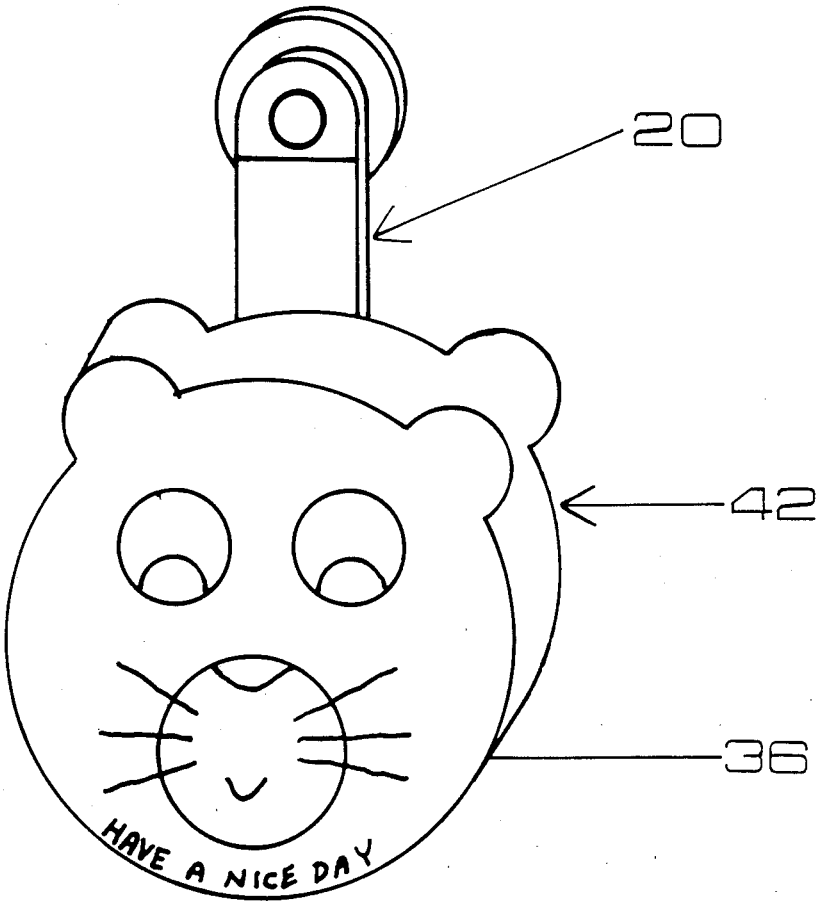
FIG. 13 is a perspective view of my invention displaying a person's sentiments and possible shape of the headrest/pillow assembly.

Protective covering 36 as shown in FIG. 7, functions as a soft, comfortable, surface for one to lay on. It functions as a protective shield for covering material 40. It functions as a surface to attach loop/soft section of "VELCRO®" 38a. The front and back sides function as a billboard to display a person's sentiments, advertising, art work, slogans, etc., which can be sewn, heat transferred, etc. onto protective covering 36, FIG. 13 shows an example.

Cushioning material 40, as shown in FIG. 7 functions as a comfortable cushioning material for one to lay on. This can take many shapes, for example animal faces, see FIG. 13 for an example.

Figure 14:
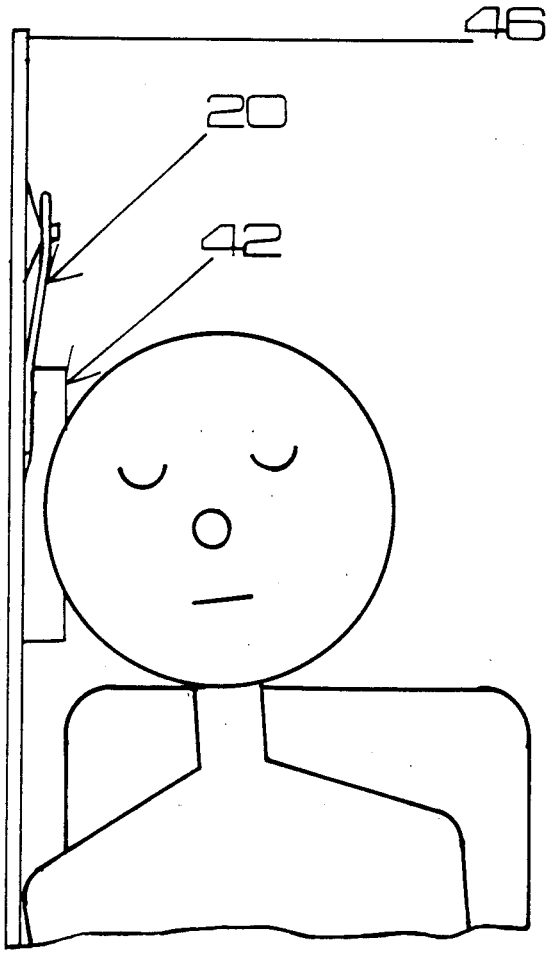
FIG. 14 is a side view of my invention being used by a person as a hanging headrest/pillow.
Figure 15:
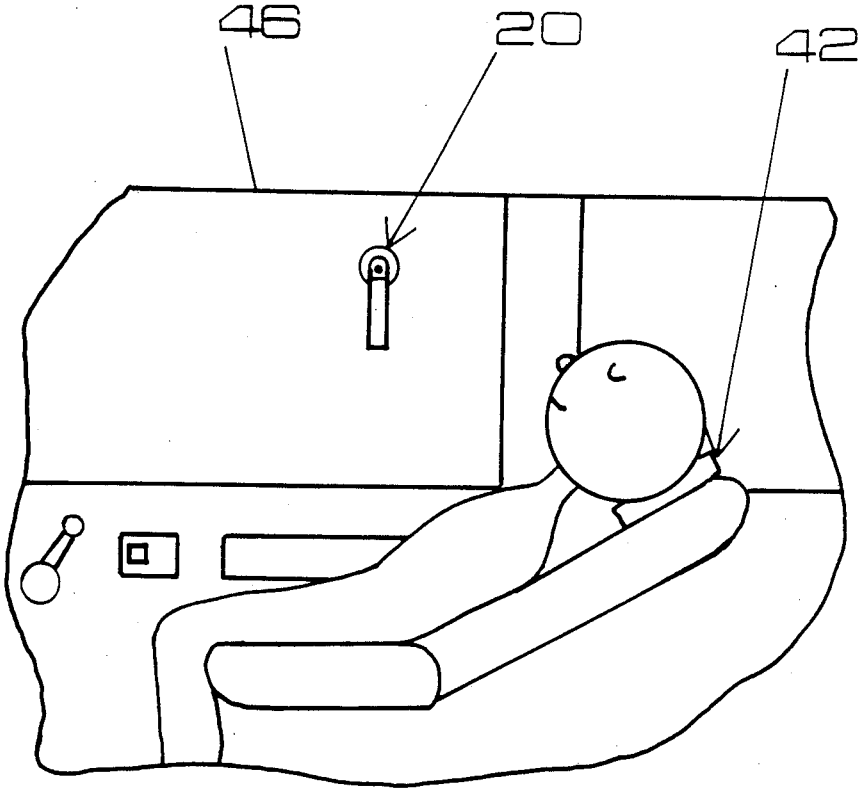
FIG. 15 is a side view of a person using my invention as a standard nonhanging headrest/pillow.

Headrest/pillow assembly 42, as shown in FIG. 14, functions as a comfort device in two ways. It functions as a hanging headrest/pillow when attached to attachment strip assembly 20 and as a convenient and comfortable nonhanging headrest/pillow when not, see FIG. 15.

In a typical embodiment the invention will easily disassemble into four parts, as shown in FIG. 2; suction cup 22, attachment strip 24, protective covering 36, and cushioning material 40. This makes it inexpensive to repair and easy to store.

SUMMARY, RAMIFICATIONS, AND SCOPE

Accordingly, the reader will see that the headrest/pillow of this invention can be hung in place easily and conveniently. The headrest/pillow assembly can be removed from the attachment strip assembly and used just as easily and conveniently as a standard nonhanging headrest/pillow. The attachment strip assembly allows a 360 degree circle attachment possibility. It also allows the point where the headrest/pillow assembly connects with the attachment strip assembly to change. Combining these two features gives the user extreme location flexibility in attaching the headrest/pillow to a surface. The interchangeable suction cup, clamp, and magnet give great surface attaching flexibility. Furthermore, the invention has the following additional advantages

- the attachment assembly will not interfere with the closure of any window or cause damage to the rubber seal around the window frame, which would cause additional road noise.
- the headrest/pillow requires less cushioning material, because the surface attachment device is not attached on the back of the headrest/pillow assembly, thereby reducing bulkiness and cost.
- allows for expression and display of sentiments, advertising, art work, slogans, etc. on the front and back sides of the headrest/pillow assembly.
- disassembles easily into many parts for convenient storage and inexpensive repair.

Although the description above contains specificities, these should not be construed as limiting the scope of the invention but as merely providing illustrations of some of the presently preferred embodiments of this invention. For example

- the headrest/pillow assembly can have other shapes, sizes, color, art work, slogans, etc.
- the attachment strip assembly can have other shapes, sizes, color, etc.
- depending on the size of the headrest/pillow assembly, there could be a larger surface attachment device or an increase number of attachment strip assemblies.

Thus the scope of the invention should be determined by the appended claims and their legal equivalents, rather than by the examples given.

I claim:

1. An article of comfort for a human, comprising:

(a) a surface attachment device to support the weight of said article of comfort and its use by a human leaning on it for comfort;
(b) an attachment strip having first and second ends;
(c) a cushioning material to accommodate the comfort of a human;
(d) a protective covering, comfortable to a human, surrounding within a perimeter edge said cushioning material;
(e) a securing means for joining said protective covering over said cushioning material;
(f) a connecting means for joining said surface attachment device to said attachment strip first end;
(g) detaching and attaching means for joining said attachment strip second end to proximate said perimeter edge of said protective covering allowing various separation and reconnection positions, whereby a human can hang said article of comfort onto various surfaces and locations for leaning onto and conveniently disconnect from said attachment strip and use as a convenient and comfortable nonhanging article of comfort.

2. The article of comfort of claim 1 wherein said surface attachment device is a suction cup.

3. The article of comfort of claim 1, wherein said surface attachment device is a clamp.

4. The article of comfort of claim 1, wherein said surface attachment device is a magnet.

5. The article of comfort of claim 1, wherein said surface attachment device is a combination suction cup, clamp, and magnet.

6. An article of comfort for humans, comprising:

(a) a surface attachment device to support the weight of said article of comfort and its use by a human leaning on said article for comfort;
(b) an attachment strip having first and second ends;
(c) a cushioning material to accommodate the comfort of a human;
(d) a protective covering, comfortable to a human, surrounding within a perimeter edge said cushioning material;
(e) a securing means for joining said protective covering over said cushioning material;
(f) a connecting means for joining said surface attachment device to said attachment strip first end; and
(g) a detaching and attaching means for joining said attachment strip second end proximate said perimeter edge of said protective covering allowing various separation and reconnection positions, whereby a human can hang said article of comfort onto various surfaces and locations for leaning onto and conveniently disconnect from said attachment strip and use as a convenient and comfortable nonhanging article of comfort.

7. An article of comfort for a user, comprising:

(a) a surface attachment device for attaching said article to a supporting surface;
(b) an attachment strip having first and second ends;
(c) means for reversibly connecting said attachment strip first end to said surface attachment device;
(d) a cushioning material to accommodate the comfort of a user;
(e) a protective covering, comfortable to said user, surrounding within a perimeter edge said cushioning material; and
(f) detaching and attaching means for connecting said protective covering proximate said perimeter edge to said attachment strip second end wherein said attachment strip is connected to said protective covering by said user at a desired rotational position.

8. An article according to claim 7, wherein said means for securing said attachment strip first end to said surface attachment device is securable to said first end at a desired rotational position.

9. An article according to claim 7, wherein said means for connecting said attachment strip first end to said surface attachment device comprises:

a collapsible/expandable peanut shaped attaching device having a top and a bottom;

said surface attachment device having a hole receiving said attaching device top that is slightly smaller than said attaching device top; and said attachment strip first end having a hole for receiving said attaching device bottom that is slightly smaller than said attaching device bottom wherein after said top and said bottom are collapsed by forcing into said holes, said top and bottom expand to secure said attachment strip to said surface attachment device.

10. An article according to claim 7, wherein said surface attachment device is a combination suction cup, clamp, and magnet.

* * * * *

UNITED STATES PATENT AND TRADEMARK OFFICE

CERTIFICATE OF CORRECTION

PATENT NO. : 4,985,950

DATED : Jan. 22,1991

INVENTOR(S) : William C. Gladish

It is certified that error appears in the above—identified patent and that said Letters Patent is hereby corrected as shown below:

Column 1, line 68, please change "easilY" to --easily--.

Column 2, in DRAWING FIGURES section, FIG. 6, after "suction" please insert --cup--.

Column 2, in REFERENCE NUMERALS IN DRAWINGS section, please change "VELCRO" in the three places it appears to --"VELCRO®"--.

Column 3, line 14, after "strip" please insert --24 with another--.

Column 4, line 18, please change "expensive" to --inexpensive--.

Column 4, line 61, please change "assemblY" to --assembly--.

UNITED STATES PATENT AND TRADEMARK OFFICE

CERTIFICATE OF CORRECTION

PATENT NO. : 4,985,950

DATED : Jan. 22, 1991

INVENTOR(S) : William C. Gladish

It is certified that error appears in the above-identified patent and that said Letters Patent is hereby corrected as shown below:

Column 6, line 13, after "end;" please insert --and--.

Column 6, line 14, before "detaching" please insert --a--.

Column 6, line 47, after "end" please insert --to--.

Column 8, line 1, after "hole" please insert --for--.

Signed and Sealed this

Fifteenth Day of September, 1992

*Attest:*

DOUGLAS B. COMER

*Attesting Officer*

*Acting Commissioner of Patents and Trademarks*